US006363631B1

(12) United States Patent
Cordingley

(10) Patent No.: US 6,363,631 B1
(45) Date of Patent: Apr. 2, 2002

(54) LATERAL PLOUGH

(76) Inventor: Donald George Cordingley, 570 Davis Drive, Uxbridge, Ontario (CA), L9P 1R1

( * ) Notice: Subject to any disclaimer, the term of this patent is extended or adjusted under 35 U.S.C. 154(b) by 0 days.

(21) Appl. No.: 09/551,879

(22) Filed: Apr. 18, 2000

Related U.S. Application Data

(63) Continuation of application No. 09/191,124, filed on Nov. 13, 1998.

(30) Foreign Application Priority Data

Nov. 14, 1997 (CA) ..... 2221108

(51) Int. Cl.[7] ..... E01H 5/06
(52) U.S. Cl. ..... 37/280; 37/281
(58) Field of Search ..... 37/266, 270, 271, 37/272, 274, 275, 276, 279, 280, 281; 172/810, 811, 815, 817

(56) References Cited

U.S. PATENT DOCUMENTS

| | | | | | |
|---|---|---|---|---|---|
| 2,144,698 | A | | 1/1939 | Allan | 37/274 X |
| 2,225,614 | A | | 12/1940 | Ball | 37/280 |
| 2,964,862 | A | | 12/1960 | Lotz | 37/280 |
| 2,988,831 | A | * | 6/1961 | Burns | 37/280 |
| 3,216,337 | A | | 11/1965 | MacDonald | 37/280 |
| 3,231,891 | A | | 1/1966 | Stegen | 343/742 |
| 3,279,104 | A | * | 10/1966 | Wandscheer et al. | 37/280 |
| 3,407,519 | A | | 10/1968 | Batko | 37/280 |
| 3,422,552 | A | * | 1/1969 | Gabel | 37/280 X |
| 4,145,825 | A | | 3/1979 | Bertolino | 37/280 |
| 4,206,812 | A | | 6/1980 | Viel | 37/280 |
| 4,217,707 | A | | 8/1980 | Karlsson | 37/280 |
| 4,962,600 | A | | 10/1990 | Zellaha et al. | 37/274 X |
| 5,285,588 | A | | 2/1994 | Niemela et al. | 37/274 X |
| 5,894,689 | A | | 4/1999 | Turk | 37/280 X |

FOREIGN PATENT DOCUMENTS

| | | | | |
|---|---|---|---|---|
| CA | 759663 | | 5/1967 | 37/280 |
| GB | 665922 | | 2/1952 | 37/274 |
| SU | 165800 | * | 1/1959 | 37/280 |

* cited by examiner

*Primary Examiner*—Victor Batson
(74) *Attorney, Agent, or Firm*—Birch, Stewart, Kolasch & Birch, LLP

(57) ABSTRACT

The lateral plough is attached to the hitch assembly of a grader or snow plough and is used to remove selected segments of an elongated pile of gravel or snow. The plough has an arcuate blade for pushing the gravel or snow forward. A gate is attached by a hinge to the outer end of the blade for preventing the gravel or snow from exiting from the blade as the grader or plough advances. The angle of the blade may be adjusted by shortening or lengthening the effective length of a chain which extends from the outer edge of the gate to the blade.

7 Claims, 7 Drawing Sheets

84
82
80
88
92
46
48
38

LATERAL PLOUGH

This application is a continuation of application Ser. No. 09/191,124 filed on Nov. 13, 1998.

This invention relates to a lateral plough for removing selected segments of an elongated pile of snow formed by a snow plough. The lateral plough also removes a pile of gravel formed by a grader.

Ploughs which are used to remove snow from a road generally have an arcuate blade which is oriented in such a way that it pushes the snow to the side of the blade and deposits it in an elongated pile or "windrow" at the edge of the road. Graders similarly have an arcuate blade which deposit gravel in a pile at the edge of the road.

The entrances of any driveways which extend from the road may be inaccessible after the plough or grader has passed. The reason is that the pile of snow or gravel at an entrance may be so high that the entrance is blocked. In such case, the snow or gravel must be removed and usually this is accomplished by hand using a shovel.

The lateral plough of the subject invention is useful for removing selected portions or segments of piles of snow or gravel. The lateral plough is attached to a front end loader, a truck or other vehicle and swings downwardly from an inoperative position in which it is above the pile of snow or gravel to an operative position in which it contacts the snow or gravel and pushes it away from the entrance of a driveway.

The lateral plough of the invention is described in detail with reference to the accompanying drawings in which.

Like reference characters refer to like parts throughout the description of the drawings.

Figure 1:
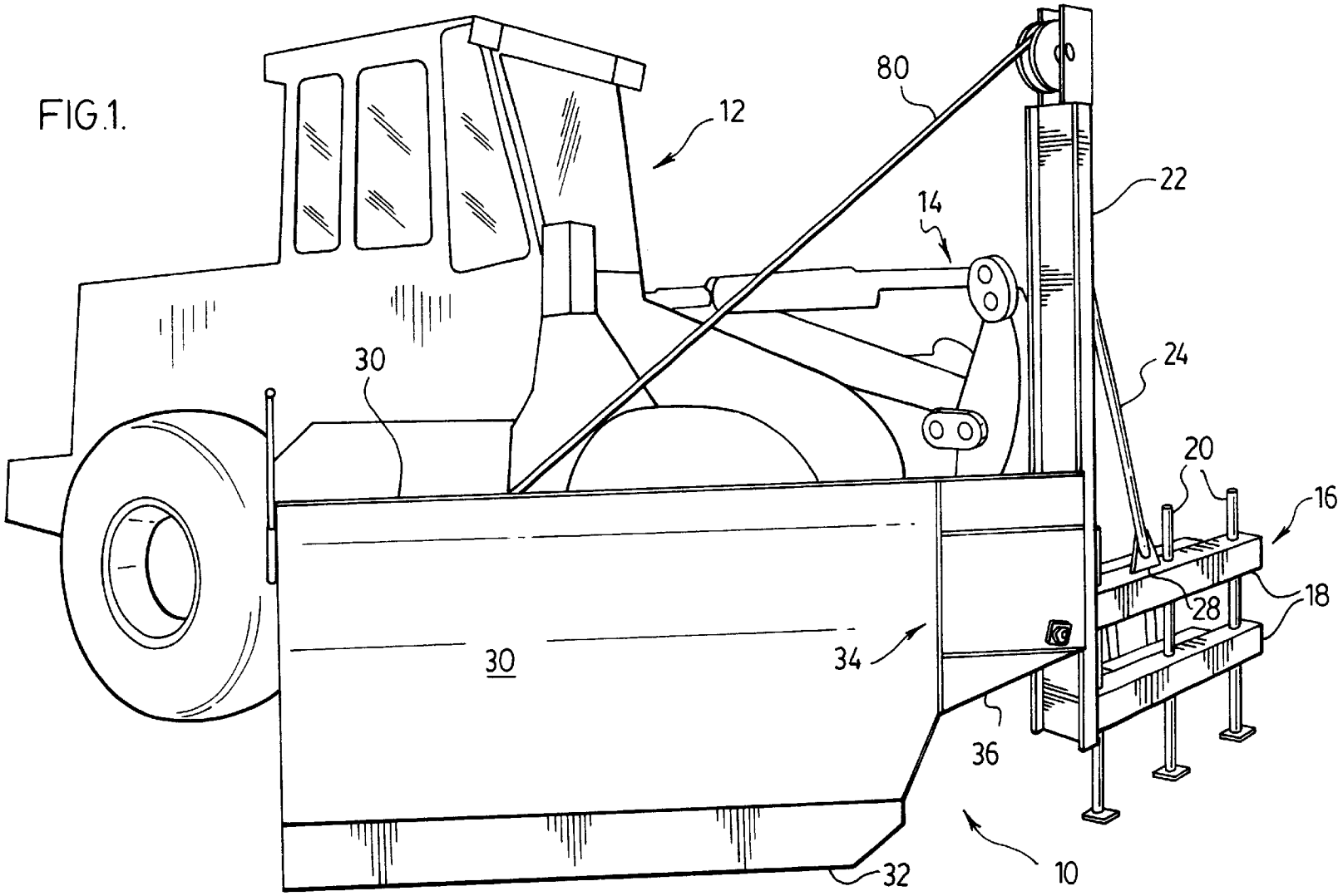
FIG. 1 is an elevation of the front of the lateral plough shown in conjunction with a front end loader.
Figure 3:
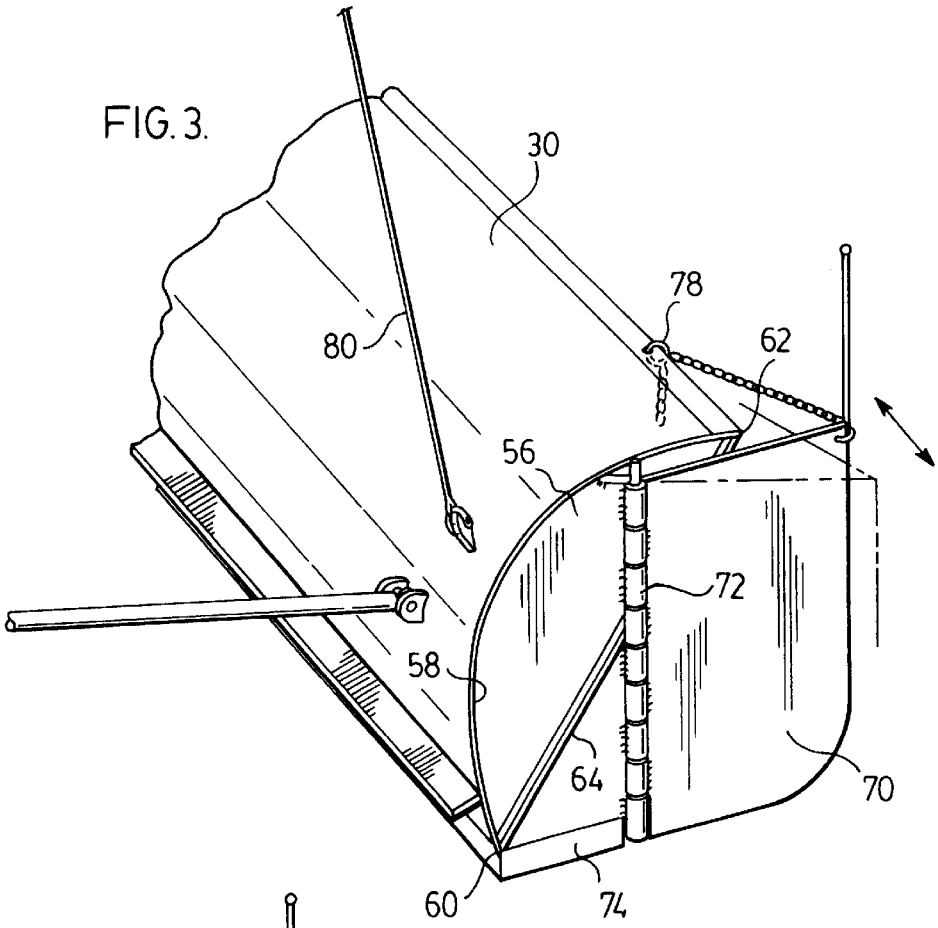
FIG. 3 is a perspective view of the outer end of the blade of the plough.

With reference to FIGS. 1 and 3, the lateral plough is indicated generally 10 and is shown in conjunction with a conventional front end loader, generally 12. The loader has a conventional hitch assembly, generally 14 at its front end which may be raised and lowered by a hydraulic or pneumatic actuator.

Figure 2:
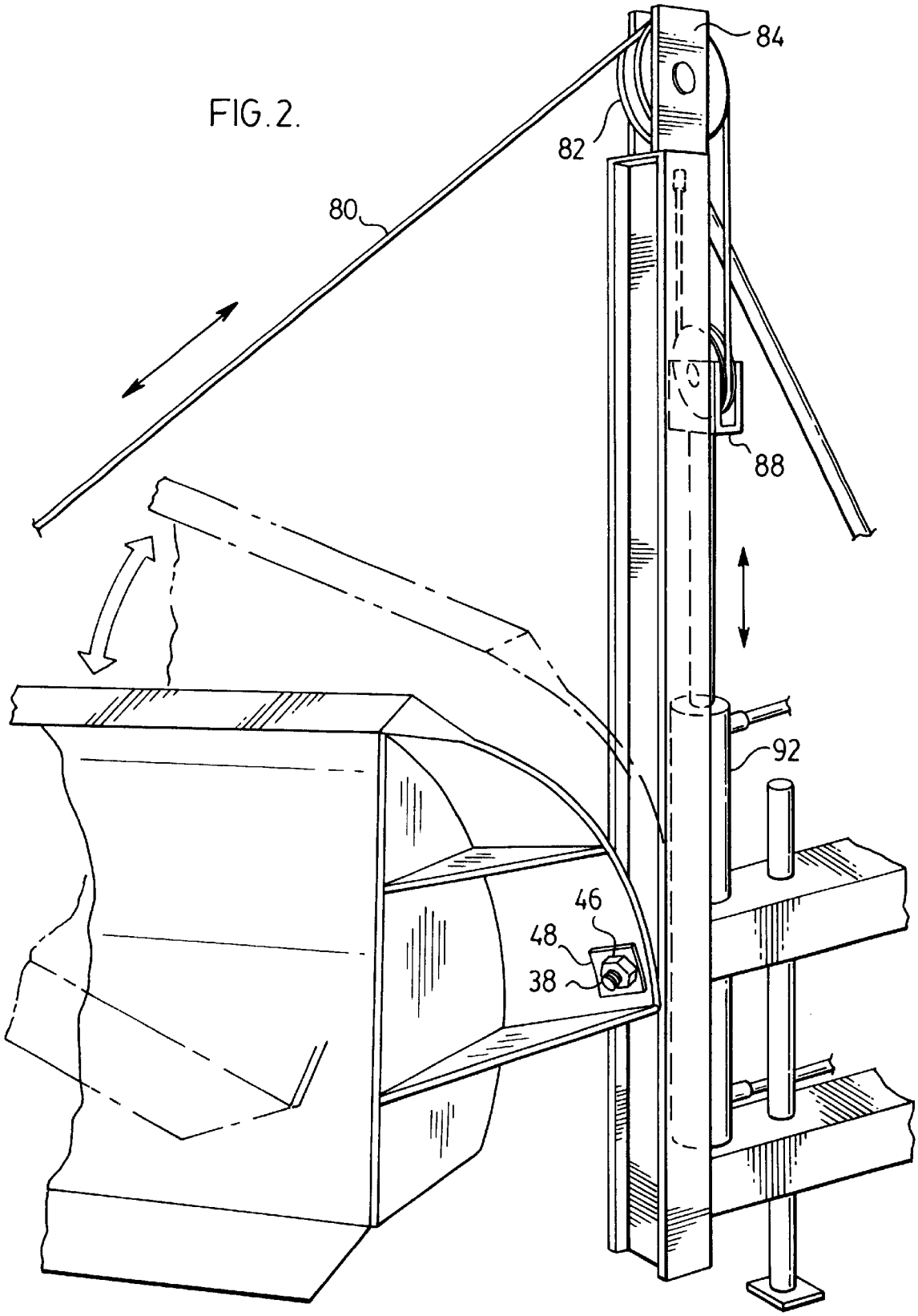
FIG. 2 is a fragmentary perspective view of the plough.

With reference to FIGS. 1 and 2, a frame, generally 16 is attached to the front of hitch assembly 14. The frame includes a pair of spaced horizontal members or channels 18 and spaced vertical members or rods 20. A vertical member or channel 22 is attached to an end of each horizontal channel.

The vertical channel is held upright by means of a brace 24 which extends from the upper end of the channel and terminates at an ear 28 which is welded to the upper horizontal channel. The entire frame, including the vertical channel, may be raised and lowered by means of the hitch assembly.

The lateral plough has an arcuate blade 30 of conventional construction. A skirt 32 formed of rubber or other flexible material is attached to the lower edge of the blade. At the inner end portion, generally 34, of the blade, i.e. the portion of the blade which is closer to the frame, the lower wall of the blade is cut at 36. The blade is cut at this point to prevent that portion of the blade from digging into the roadway as the outer end of the blade pivots upward.

Figure 7:
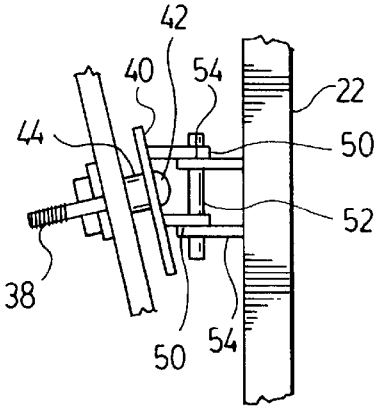
FIG. 7 is an enlarged fragmentary view on arrow 7 of FIG. 6 showing the means by which the blade of the plough is attached to a vertical channel.

As seen in FIGS. 2 and 7, a threaded stud 38 extends through an opening in the end portion and through an opening in plate 40 behind the blade. The stud terminates at a head 42. A bearing ring 44 separates the blade from the plate and allows the blade to pivot or rotate relative to the plate. A nut and washer 46, 48 hold the stud in position.

A pair of rods 50 extend from the opposite side of plate 40 and are rotatably mounted to a trunnion 52. The trunnion is supported by a pair of rods 54 which are attached to a vertical channel 22.

Figure 4:
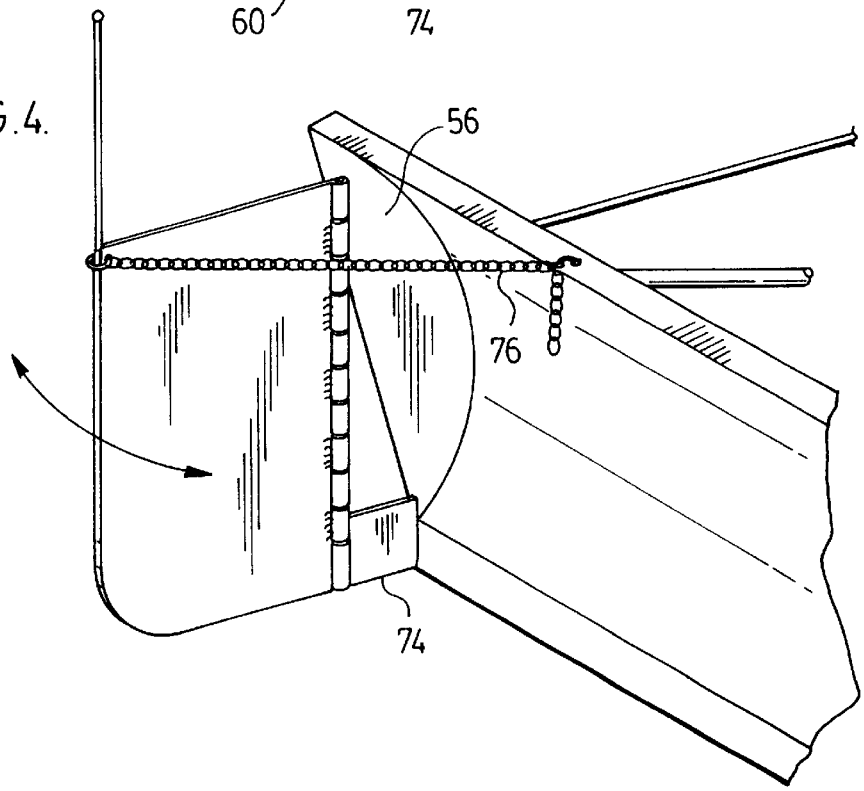
FIG. 4 is a perspective view of the side of the blade opposite that shown in FIG. 4.

With reference to FIGS. 3 and 4, at the outer end of the blade, i.e. the end opposite stud 38, an end wall 56 is formed. The wall has an arcuate rear edge 58 which conforms to the shape of the blade and which extends from the lower edge 60 of the blade to its upper edge 62. The front edge 64 of the end wall roughly coincides with an imaginary line which runs normally between the lower and upper edges 60, 62.

A flap or gate 70 is attached by means of a hinge 72 to the upper portion of the end wall and to a lug 74 which projects from the lower portion of the end wall. The end wall and the gate cooperate with the blade to confine any snow or gravel which is being pushed by the blade and to prevent the snow or gravel from discharging beyond the end of the blade.

A chain 76 is fixed to gate 70 and extends to a hook 78 which is attached to the upper edge of the blade. The effective length of the chain may be adjusted by changing the link to which the hook is attached. By adjusting that length, the angle of the gate relative to the blade may be adjusted.

Figure 5:
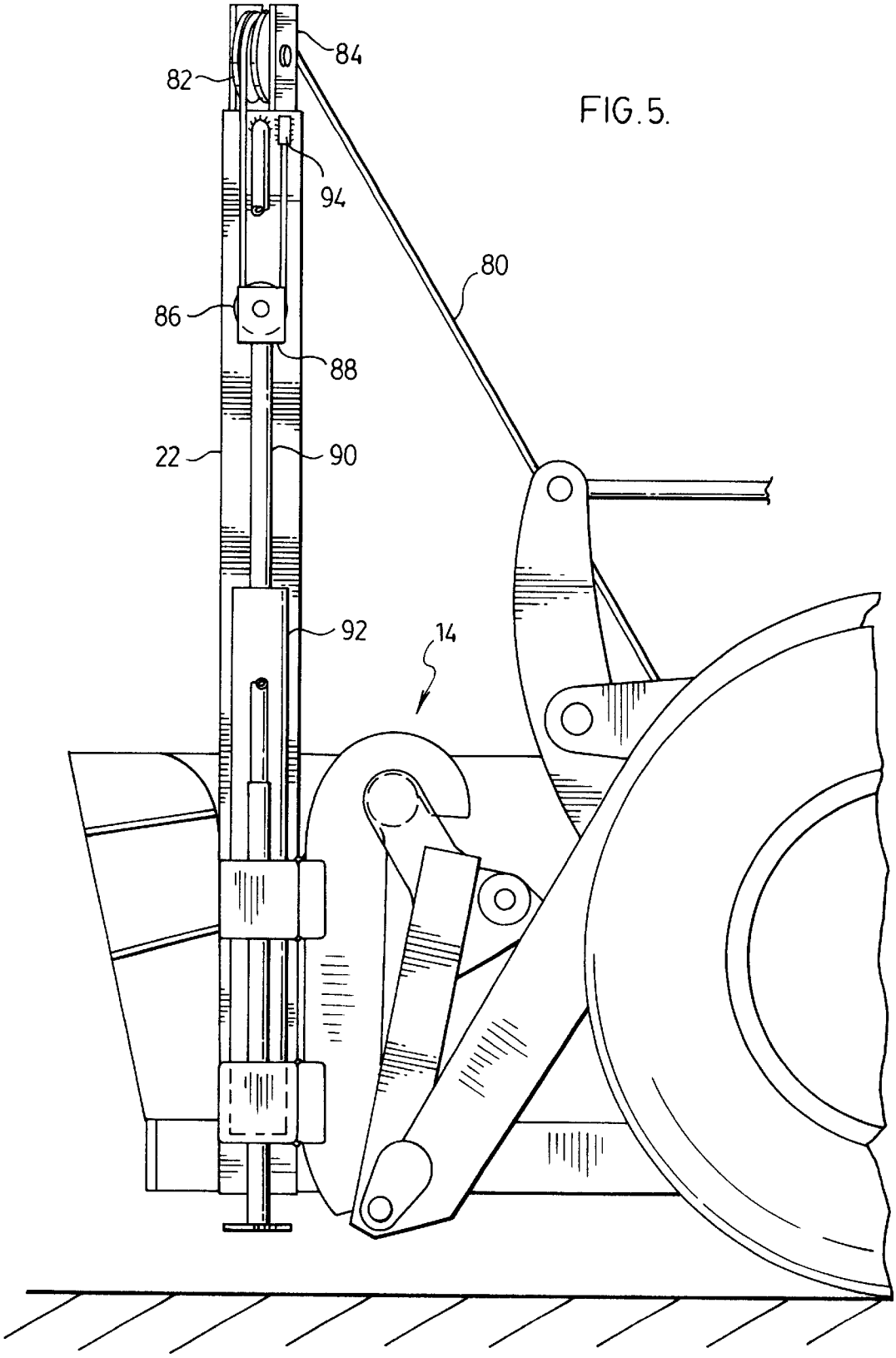
FIG. 5 is an elevation showing the mechanism by which the blade is raised and lowered.

With reference to FIGS. 2 and 5, a wire cable 80 is attached to the rear wall of the blade adjacent to its outer end. The cable extends upwardly and around a sheave 82 mounted for rotation in clevis 84. The clevis is mounted to a swivel at the top of the vertical channel 22. The cable extends downwardly from the sheave and around a second sheave 86 attached to a clevis 88 at the end of the piston 90 of an actuator 92. The end of the cable is attached to the channel at 94.

By means of the actuator the outer end of the blade may be raised and lowered. As it does the inner end of the blade pivots about stud 38.

Figure 6:
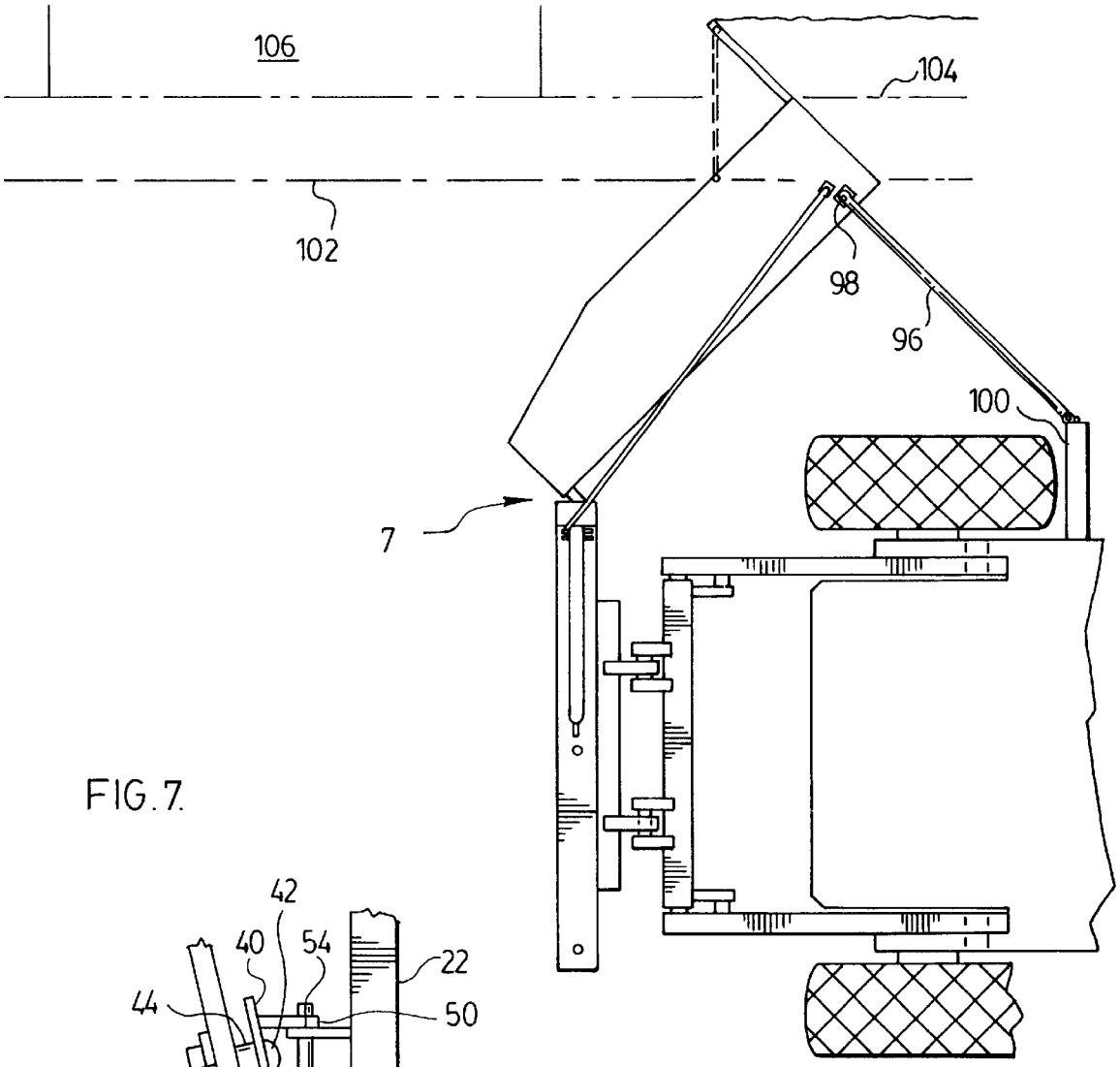
FIG. 6 is a plan view of the plough and loader.

With reference to FIG. 6, a strut 96 is pivotally attached to the rear of the blade at 98 and to a bar 100 which is attached to the loader. The strut prevents the outer end of the blade from rotating to the rear while allowing the end to move up and down.

The operation of the lateral plough is as follows: Snow or gravel is in a pile 102 which runs along the edge 104 of a road. Before the blade reaches the entrance 106 of a driveway, its outer end is raised above the pile so that it does not contact it. When the outer end reaches the entrance, the operator of the plough allows the outer end to drop by means of actuator 92. The blade is now in contact with the pile and as it advances, snow or gravel ahead of it collects in the blade. Gate 70 and end wall 56 prevent the snow or gravel from exiting from the outer edge of the blade.

When the plough has passed the entrance, the blade is raised and snow or gravel in front of the blade will be deposited on the road but not in front of the entrance.

Various adjustments are possible to adapt the plough to the conditions under which it is operating. The angle of the gate relative to the blade may be adjusted to increase or decrease the size of swath which is removed by the blade. The angle of the blade relative to the direction of travel of the loader may be adjusted by lengthening or shortening strut 96. Trunnion 52 allows the inner end of the plough to pivot about frame 16 at the front of the loader.

Figure 8:
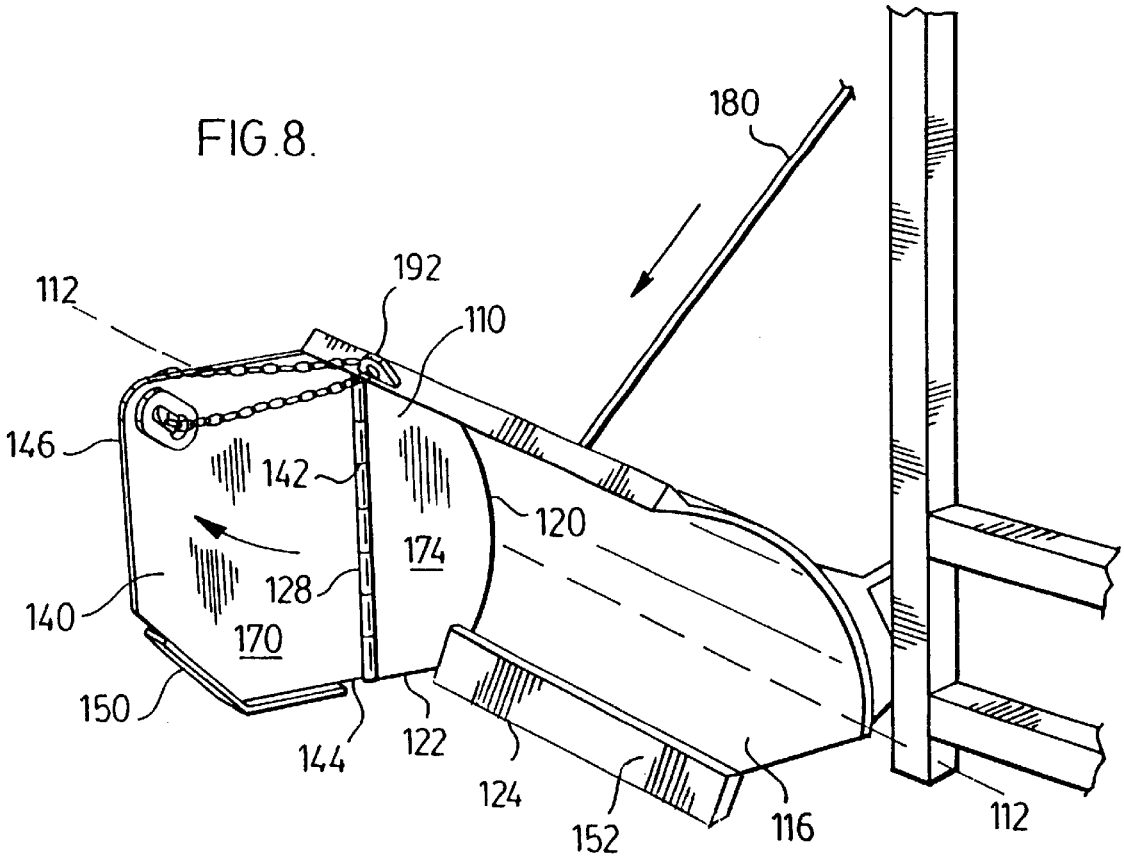
FIG. 8 is a perspective view of a second embodiment of the outer end of the blade of the plough showing the gate open in an operative position.

With reference to FIG. 8, end wall 110 extends perpendicular to the longitudinal axis 112-112 of the blade 116 and has an arcuate rear edge 120 which conforms to the shape of the front face of the blade. The lower edge 122 of the end wall extends outwardly roughly perpendicular to the longitudinal axis of the blade such that the lower edge of the blade 124 and the lower edge of the end wall are roughly horizontal when the blade is in the operative position illustrated in that Figure. The front edge 128 of the end wall is perpendicular to the lower edge 122.

Gate or flap 140 is attached by means of an elongated hinge 142 to the front edge 128 of the end wall. The gate has a lower edge 144 which is aligned with the lower edge 122 of the end wall. That edge along with the outer edge 146 of the gate contact snow and gravel on a road and are reinforced by means of a skid 150 which extends along both edges.

Preferably the skid is about 4 inches above the lower edge of the blade. In other words the lower edges of the blade and gate 124, 144 lie in imaginary planes parallel to one another and separated by a distance in the range of approximately 4 to 6 inches measured on a line normal to the planes. When the skid is above the lower edge of the blade, it will be above the road when the blade is in the operative position and be less likely to damage the ramps at the entrances of driveways when the plough is used to remove snow and gravel from such entrances.

A skirt 152 of rubber or other suitable material is attached to and extends below the lower edge of the blade to protect it and the road as the plough moves along the road.

Figure 10:
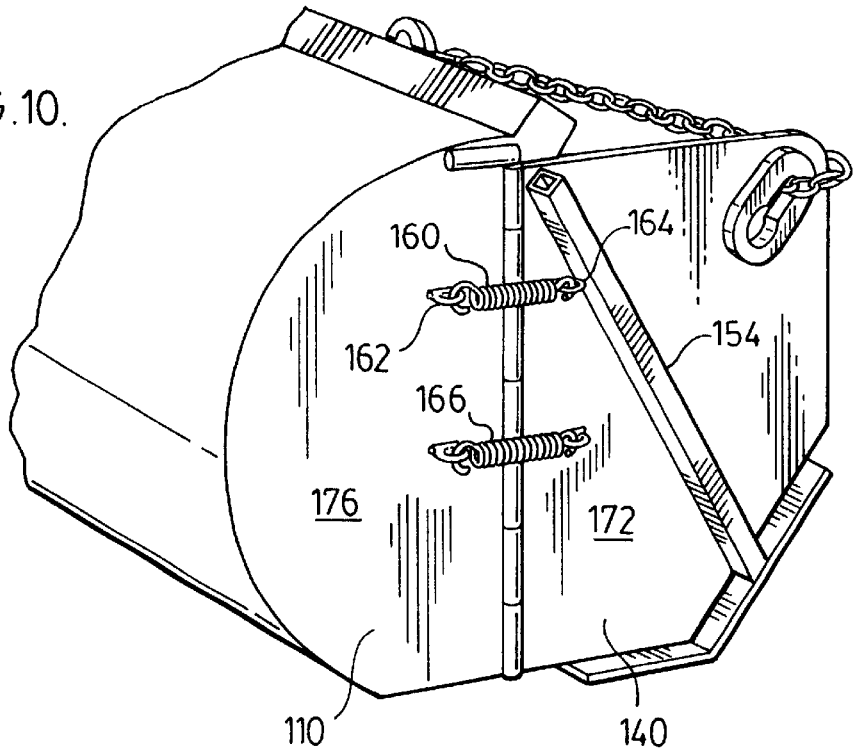
FIG. 10 is a perspective view of the side of the blade opposite that shown in FIG. 8, in enlarged scale.

With reference to FIG. 10, the skid is reinforced by a strut 154 which extends upwardly from the skid and is welded or is otherwise attached to the outer face of the end wall.

Resilient means in the form of a coil spring 160 is connected by rings 162, 164 to the outer faces of the end wall 110 and the gate 140 respectively. Spaced vertically below the spring is a second coil spring 166 which also interconnects the end wall and the gate. The springs serve to resiliently bias the gate to the open or operative position illustrated in FIGS. 8 and 10. When the gate is fully open, the inside and outside faces 170, 172 of the gate are roughly coplanar with or parallel to the inner and outer faces 174, 176 respectively of the end wall.

When the blade is in the operative position, its end wall and the gate are roughly at the same elevation and gravity has little effect on the operation of the gate. When however the blade is raised by means of cable 180, gravity has an increasing influence on the operation of the gate.

Figure 9:
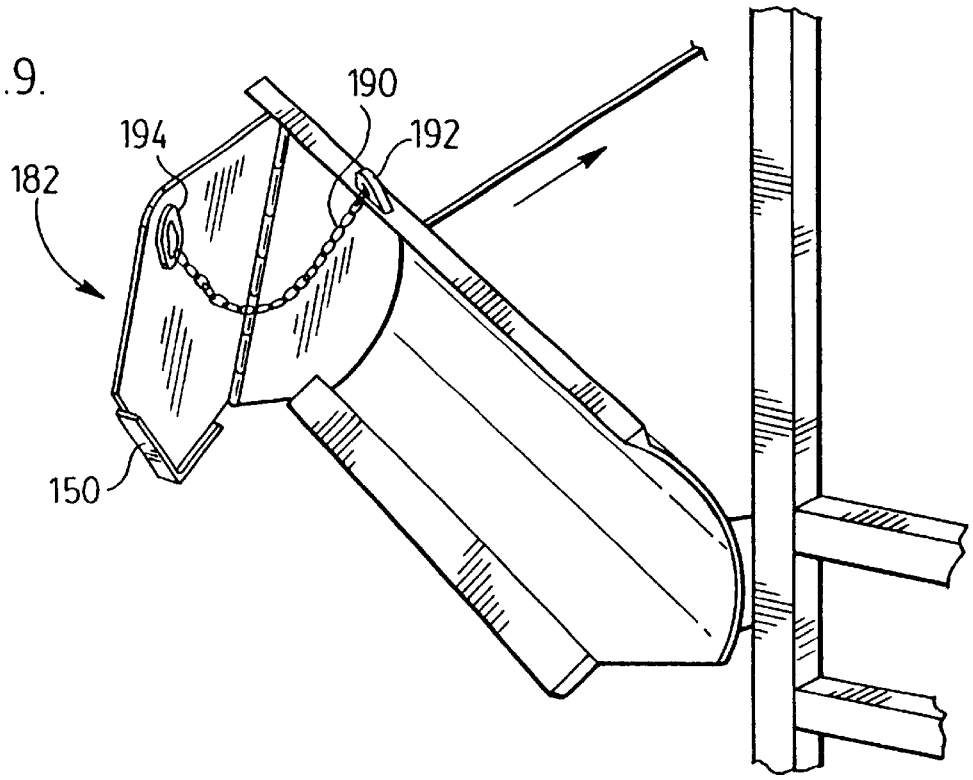
FIG. 9 is a perspective view of the blade shown in FIG. 8 showing the gate as it closes to an inoperative position.
Figure 11:
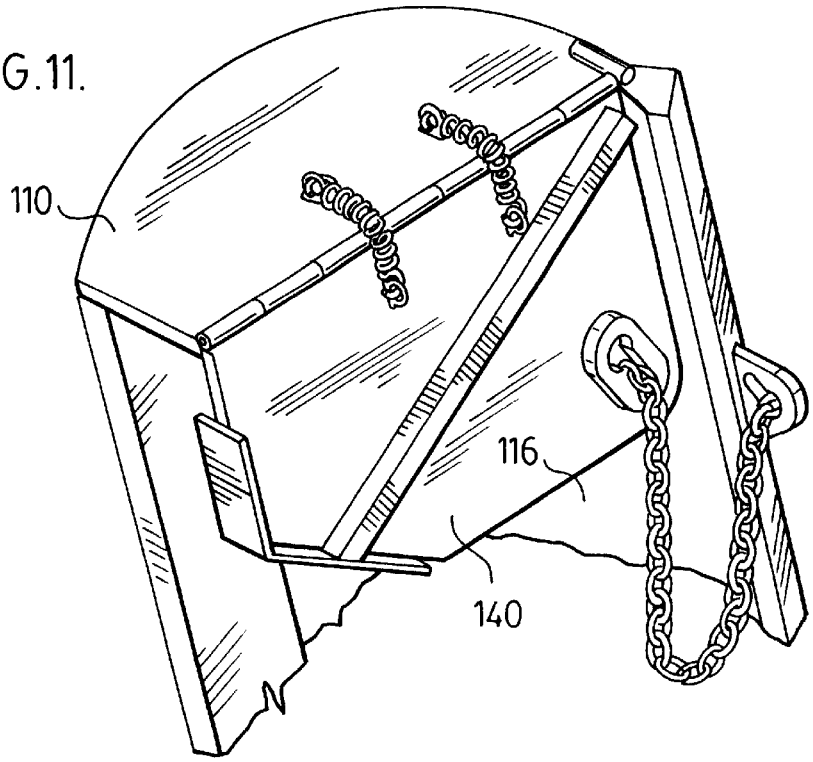
FIG. 11 is a perspective view of the outer end of the blade showing the gate closed in an inoperative position.

With reference to FIG. 9, as the gate rises, gravity begins to urge the gate to swing downward in the direction of arrow 182. If the springs are sufficiently strong, they will overcome the force of gravity and prevent such swinging. The springs are however deliberately chosen to allow such swinging to occur. In other words, the springs are designed to allow the gate to swing shut as illustrated in FIG. 11 when the blade is in an inoperative position. Gravity thus serves to oppose and to overcome the bias of the springs and causes the gate to close.

Accordingly when the outer end of the blade is raised by means of cable 180, gravity overcomes the bias of springs 160, 166 and causes the gate to swing toward blade 116. In FIG. 9 the gate begins to swing shut as the outer end of the blade begins to rise and in FIG. 11, the blade is almost vertical and the gate is fully shut.

There are many reasons why it is desirable for the gate to close when the blade is in the inoperative position. First, if the gate is open when the outer end is raised to its inoperative position, the gate can damage cars, poles and other obstructions beside the plough as it travels along a road. The reason is that the operator's vision of the gate is obscured by the hitch and blade when the blade is in the inoperative position and he cannot see the gate well enough to avoid such damage from occurring. Secondly, the centre of gravity of the blade is lower when the gate is closed. As a result when the blade is in the inoperative position, it is more stable and less likely to be damaged by jerks resulting from sharp turns of the plough or from pot holes in the road. As well the hitch and plough are less likely to be damaged by such jerks. Thirdly, the plough is more manoeuvrable around curbs, in driveways and other tight spaces if the gate closes when the plough is raised. If the gate remains open, it can damage curbs, berms, hydrants, poles and the like beside a road. It can also be damaged by them.

With reference to FIGS. 9 and 10, chain 190 passes through an aperture in an ear 192 on the upper edge of the blade and through a slot 194 in the gate. The size of the slot varies from relatively narrow at its upper end to relatively large at its lower end. The links of the chain may pass through the lower end of the slot but not the upper.

The effective length of the chain between the gate and blade can be adjusted by passing the chain through the lower end of the slot until the desired length is achieved then raising the chain in the slot until the link within the slot is engaged by the walls of the slot.

Chain 190 allows the gate to swing freely between open and closed positions. The chain allows the position of the chain, when it is open, to be adjusted. In most cases the length will be adjusted to ensure that the gate is perpendicular to the longitudinal axis of the blade when the gate is open but in some cases it may be desirable that the angle between the gate and blade be less than 90 degrees as is discussed above. It is undesirable for the gate to be open wider because if the gate strikes a bump in the road or some other obstruction, the gate may open even wider with resulting damage to the hinge, chain and the ear and slot to which the chain is attached.

It will be understood of course that modifications can be made in the preferred embodiments illustrated and described herein without departing from the scope and purview of the invention as described herein.

I claim:

1. A lateral plough adapted to be attached to a hitch assembly of a motor vehicle for removing selected segments of an elongated pile of particulate material comprising: a blade having an inner end adapted to be in proximity to said motor vehicle and an outer end adapted to be remote from said vehicle, said blade adapted to swing from an operative position in which its ends are at approximately the same elevation and said blade is in position to push said particulate material forward to an inoperative position in which said outer end is higher than said inner end; a gate pivotally disposed at the outer end of said blade and having an outer edge which swings toward said blade to a closed position in which said outer edge is adjacent to said blade and which swings away from said blade to an open position in which said gate prevents said particulate material pushed by said blade from exiting from the blade as said plough advances; resilient means for biasing said gate open when said blade is in said operative position but being opposed and overcome by the force of gravity when said blade is in said inoperative position thereby allowing said blade to close.

2. The plough as claimed in claim 1 further including means for limiting the extent to which said gate pivots between said open and closed positions.

3. The plough as claimed in claim 1 further including a flexible chain which extends between said blade and said gate, and means for adjusting the effective length of said chain to limit the extent to which said gate pivots between said open and closed positions.

4. The plough as claimed in claim 1 wherein said blade and said gate have lower edges which are parallel to one another, the lower edge of said gate being spaced above that of the lower edge of said blade when said gate is in said operative position.

5. The plough as claimed in claim 4 wherein the distance between the lower edge of said gate and said blade is in the range of approximately four to six inches measured on a line normal to said edges.

6. A lateral plough adapted to be attached to a hitch assembly of a motor vehicle for removing selected segments of an elongated pile of particulate material comprising: a blade having a longitudinally extending axis and having an inner end adapted to be in proximity to said motor vehicle and an outer end adapted to be remote from said vehicle, said blade adapted to swing from an operative position in which its ends are at approximately the same elevation and said blade is in position to push said particulate material forward to an inoperative position in which said outer end is higher than said inner end, said blade having an end wall at the outer end thereof, said end wall extending laterally from the longitudinal axis of said blade; a gate pivotally attached to said end wall for preventing said particulate material pushed by said blade from exiting from the blade as said plough advances, said gate being pivotal from an open position in which said gate prevents said particulate material pushed by said blade from exiting from the blade as said plough advances to a closed position in which said gate is adjacent to said blade; resilient means for biasing said gate open when said blade is in said operative position but being opposed and overcome by the force of gravity when said blade is in said inoperative position thereby allowing said blade to close.

7. An assembly for removing selected segments of an elongated pile of particulate material including: a frame adapted to be attached to a hitch assembly of a motor vehicle; a lateral plough having opposite ends, one said end being pivotally connected to said frame and the other said end terminating at an end wall, said plough having an arcuate blade for pushing said particulate material and having a gate pivotally attached to said end wall; and means for causing said plough to pivot about said frame with resulting raising and lowering of said end wall; said pivotal connection between said plough and said frame comprising a stud which extends from said plough to a plate, a pair of first rods extending from said plate and being rotatably mounted to a trunnion and a pair of second rods which are fixed to said trunnion and to said frame.

* * * * *